US006955454B2

(12) United States Patent
Trappani et al.

(10) Patent No.: US 6,955,454 B2
(45) **Date of Patent: *Oct. 18, 2005**

(54) PLASMA LAMP HEAD

(75) Inventors: James Trappani, Ft. Lauderdale, FL (US); Patrick Ryan, Cooper City, FL (US); Steve Handelsman, Ft. Lauderdale, FL (US); Michael Mao, Taipei (CN)

(73) Assignee: Atico International USA, Inc., Ft. Lauderdale, FL (US)

( * ) Notice: Subject to any disclaimer, the term of this patent is extended or adjusted under 35 U.S.C. 154(b) by 183 days.

This patent is subject to a terminal disclaimer.

(21) Appl. No.: 10/041,284

(22) Filed: Jan. 8, 2002

(65) Prior Publication Data

US 2003/0128545 A1 Jul. 10, 2003

(51) Int. Cl.[7] ..... F21V 33/00

(52) U.S. Cl. ..... 362/351; 362/806; 362/808; 362/362

(58) Field of Search ..... 315/35; 362/806, 362/808, 362, 124, 351, 361, 811; D26/26, 99, 126, 128; 40/73; 446/491, 484

(56) References Cited

U.S. PATENT DOCUMENTS

| | | | | | |
|---|---|---|---|---|---|
| D79,130 | S | | 9/1929 | Ciffo | |
| D227,186 | S | | 6/1973 | Dangeli | |
| 4,754,199 | A | * | 6/1988 | Parker | 315/85 |
| D310,422 | S | | 9/1990 | Shupe | |
| D316,300 | S | | 4/1991 | Hedges | |
| D356,167 | S | | 3/1995 | Bohannon | |
| D370,282 | S | | 5/1996 | Grether | |
| 5,618,102 | A | | 4/1997 | Ferrell | |
| D381,440 | S | | 7/1997 | Cheung | |
| D391,663 | S | * | 3/1998 | Serre-Vives | D26/99 |
| D407,163 | S | | 3/1999 | Berkowitz | |
| 5,949,180 | A | | 9/1999 | Walker | |
| D428,513 | S | | 7/2000 | Lee et al. | |
| D428,664 | S | | 7/2000 | Lee et al. | |
| D429,364 | S | | 8/2000 | Li | |
| D441,882 | S | | 5/2001 | Lee | |
| D451,623 | S | | 12/2001 | Zuloff | |
| D451,624 | S | | 12/2001 | Zuloff | |
| D457,665 | S | | 5/2002 | Lee | |
| D460,572 | S | * | 7/2002 | Lee | D26/26 |
| D480,984 | S | * | 10/2003 | Trappani et al. | D11/125 |

* cited by examiner

*Primary Examiner*—Stephen Husar
*Assistant Examiner*—Anabel M Ton
(74) *Attorney, Agent, or Firm*—Gibbons, Del Deo, Dolan, Griffinger & Vecchione

(57) ABSTRACT

A plasma lamp head that has a spherical plasma bulb whose upper hemisphere serves as the top of the head, a decorative face and lower back of the head covering the lower hemisphere of the bulb. Operative components are provide to enable the bulb to illuminate in response to receipt of appropriate energy delivery to excite the plasma within the bulb to illuminate. The face preferably has eyes, a nose, a mouth and ears, any of which may be transparent or translucent so that light shines through when the bulb illuminates. The remainder of the decorative face and lower back of the head may be opaque or translucent material.

21 Claims, 6 Drawing Sheets

PLASMA LAMP HEAD

BACKGROUND OF THE INVENTION

1. Field of the Invention

The invention relates to a decorative plasma lamp that provides illumination and appears as a head with a face and with an illuminated cranium.

2. Discussion of Related Art

The construction of plasma lamps are conventional, such as in U.S. Pat. Nos. 5,618,102 and 5,949,180 both of whose contents are incorporated by reference. Decorative plasma lamps are disclosed in various patents, such as, a dolphin shape in U.S. Pat. No. D441,82 S, and ornamental shapes in U.S. Pat. No. Des. 428,664 and U.S. Pat. No. Des. 428,513. Non-plasma light bulbs have been disclosed as configured into a skull, as in U.S. Pat. No. Des. 407,163, or a human head, as in U.S. Pat. No. Des. 79,130, or a cartoon character-like head in U.S. Pat. No. Des. 310,422, or a pumpkin head, as in U.S. Pat. No. Des. 356,167.

What is needed from a novelty standpoint is the use of a plasma bulb to appear as the top of a head.

BRIEF SUMMARY OF THE INVENTION

One aspect of the invention resides in a plasma lamp head that includes a plasma lamp bulb and a decorative configuration. The bulb has upper and lower hemispheres. The decorative configuration covers the lower hemisphere and is clear of at least a portion of the upper hemisphere. Operative components are arranged to enable activation of the bulb to provide illumination upon the delivery of sufficient electrical energy to the operative components.

The decorative portion preferably includes a face, such as an imaginary one of a monster, alien, freak or mutant. The upper hemisphere of the bulb appears as a transition from the top of the face to complete a head. When illuminated, the upper hemisphere provides the effect of a glowing top of the head, which provides a stark contrast to the face if the face is opaque or translucent. For added effect, the eyes, nose, mouth and/or ears of the face may have a transparent or color filtered translucent portion to provide a further contrast in illumination relative to the face. The decorative portion may also include the lower back of the head to complete coverage of the lower hemisphere.

BRIEF DESCRIPTION OF THE SEVERAL VIEWS OF THE DRAWING

For a better understanding of the present invention, reference is made to the following description and accompanying drawings, while the scope of the invention is set forth in the appended claims.

DETAILED DESCRIPTION OF THE INVENTION

Figure 1:
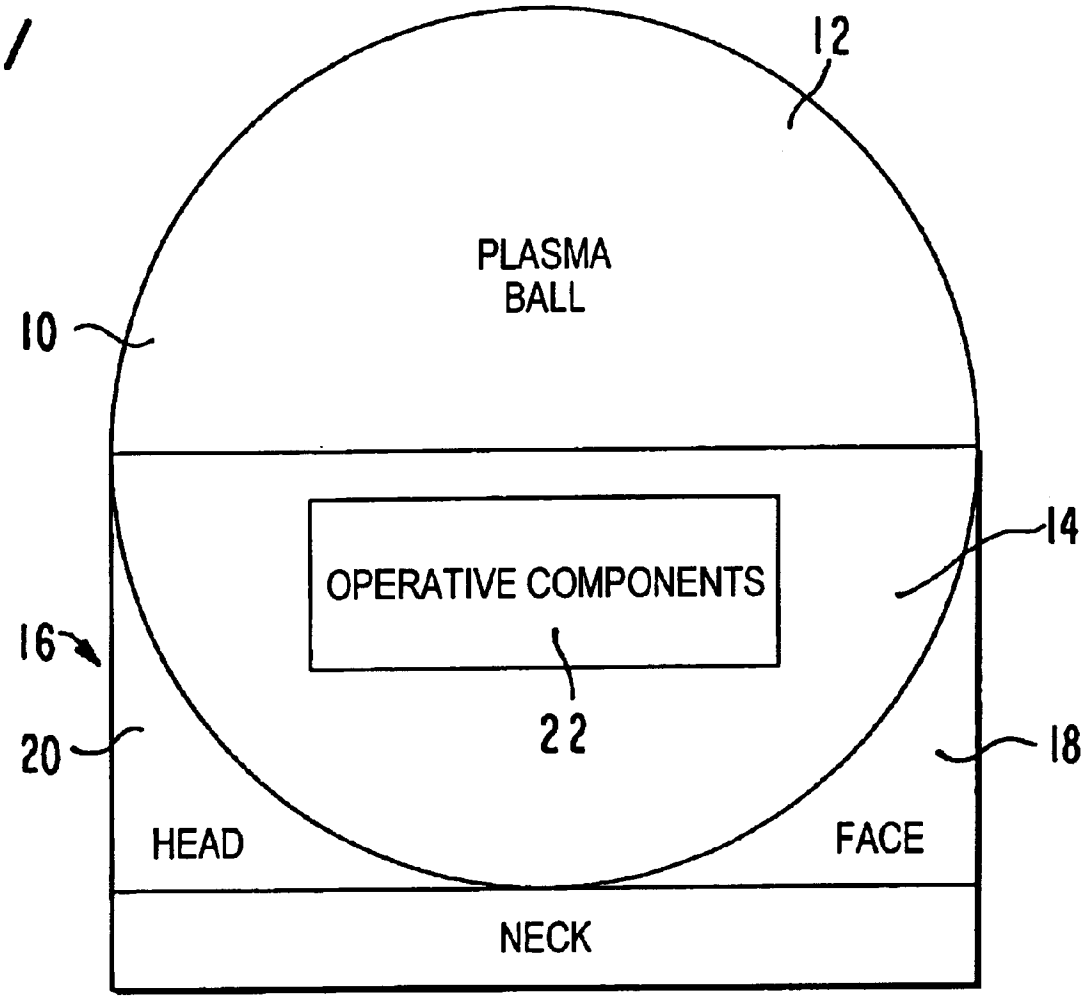
FIG. 1 is a schematic representation of the present invention.

Turning to the drawing, FIG. 1 shows a plasma lamp bulb 10 that has an upper hemisphere 12 and a lower hemisphere

14. The bulb 10 is fitted within a decorative portion 16 that surrounds and substantially covers the lower hemisphere 14 possibly part of the upper hemisphere 12. The decorative portion 16 includes a face 18 and a lower back 20 of a head or cranium. The upper hemisphere 14 appears as the upper half of the head or cranium.

The decorative portion is preferably constructed of an opaque or translucent material and is heat resistant to the extremes of temperature caused by being in close proximity to the plasma lamp bulb 10. The decorative portion may be made of a transparent material such as glass, but should be suitably painted or colored for a more pronounced facial effect.

Operative components 22 are provided that enable the bulb 10 to illuminate in response to delivery of a sufficient amount of energy. The operative components may include electrodes or leads that energize in response to the energy being provided. The electrodes or leads may be within or without the bulb 10. A power cord may be used to provide power to the operative components from an electrical outlet.

The bulb 10 contains a plasma forming substance so that a plasma charge occurs within the bulb between an anode and a cathode to provide illumination of the bulb. The plasma forming gaseous substance may be any conventional material used to form a plasma, such as sulfur, selenium or the like that is capable of excitation to form the plasma. Other plasma discharge light sources may be used, such as neon, fluorescent or high intensity discharge.

Figure 4:
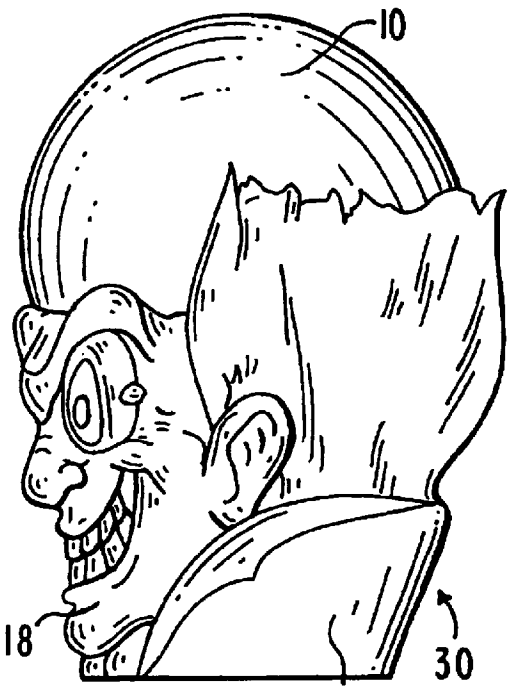
FIGS. 2, 3 and 4 are left, front and right side views of a first embodiment.
Figure 3:
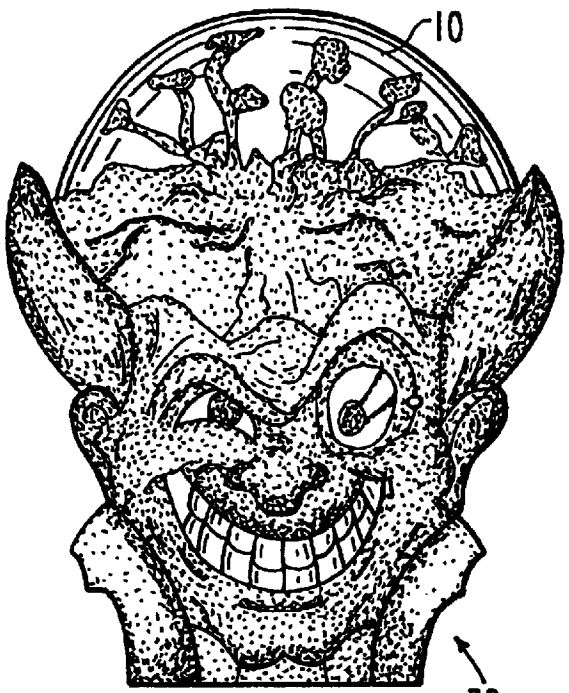
Figure 2:
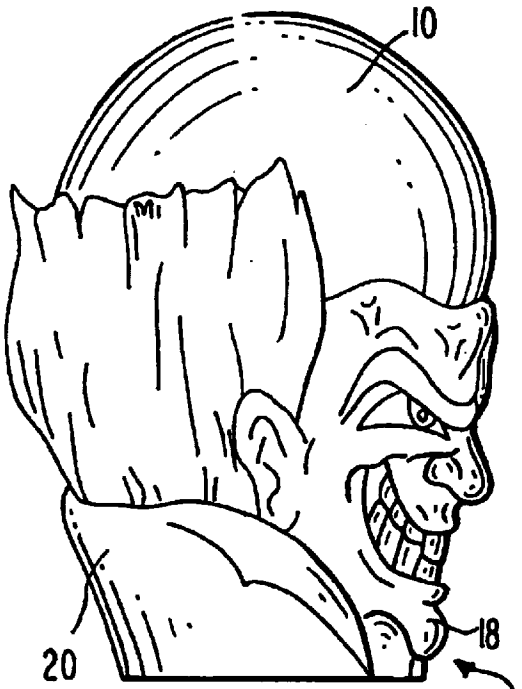
Figure 7:
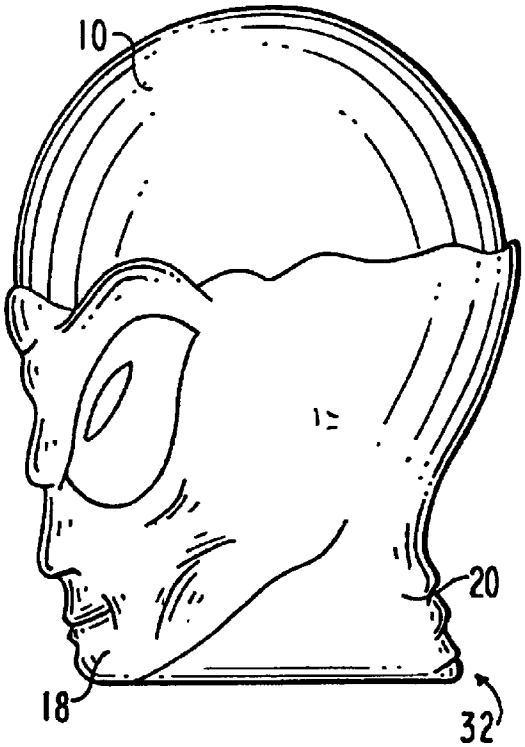
FIGS. 5, 6 and 7 are left, front and right side views of a second embodiment.
Figure 6:
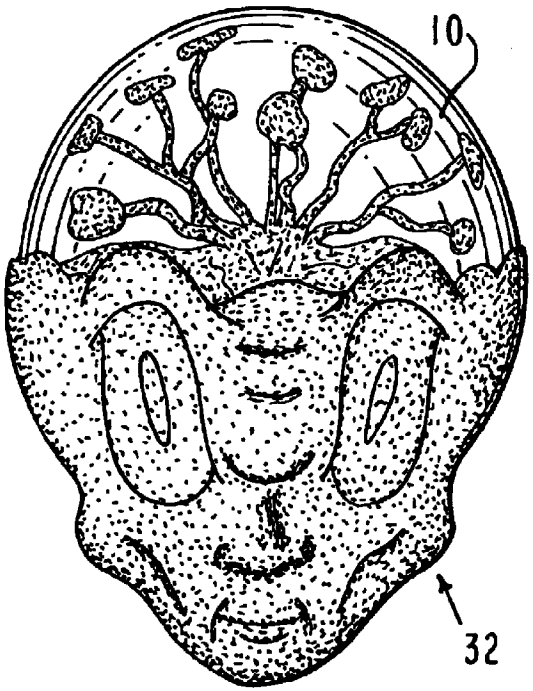
Figure 5:
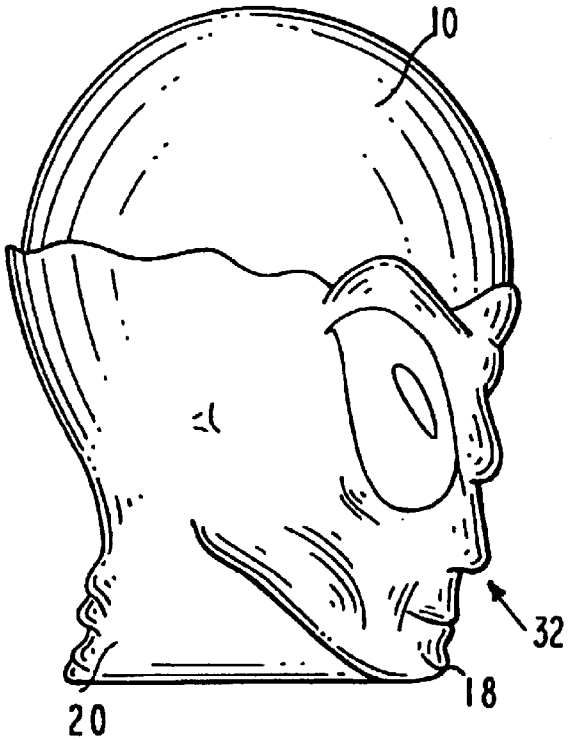
Figure 10:
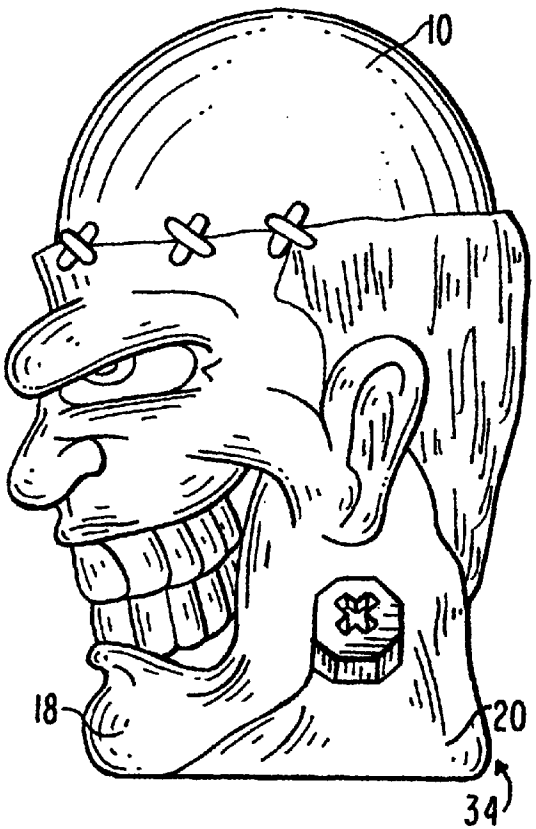
FIGS. 8, 9 and 10 are left, front and right side views of a third embodiment.
Figure 9:
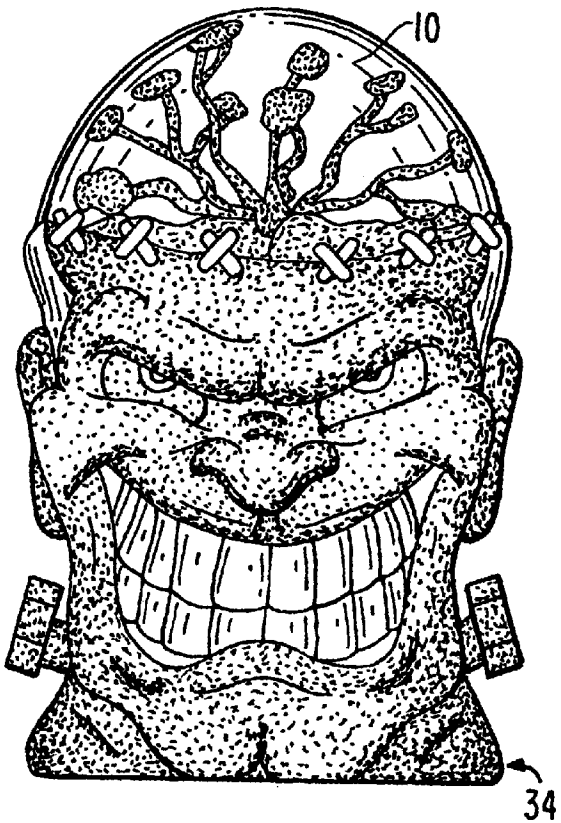
Figure 8:
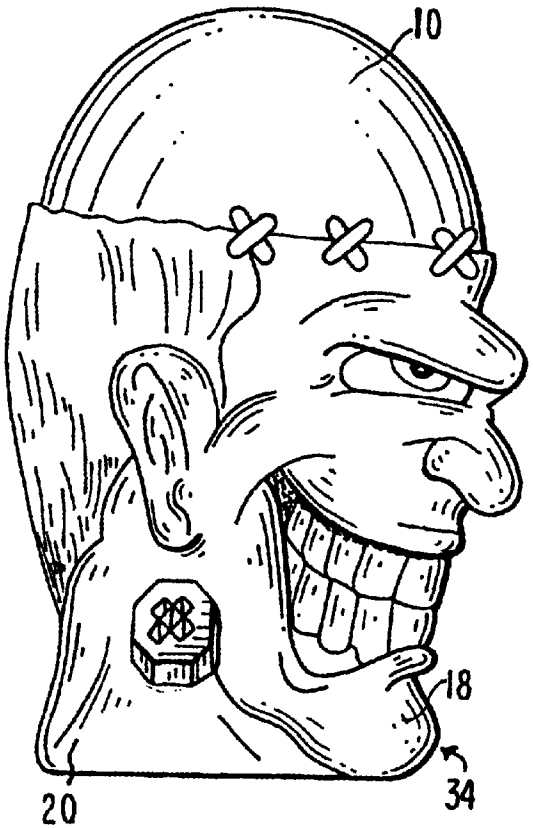
Figure 13:
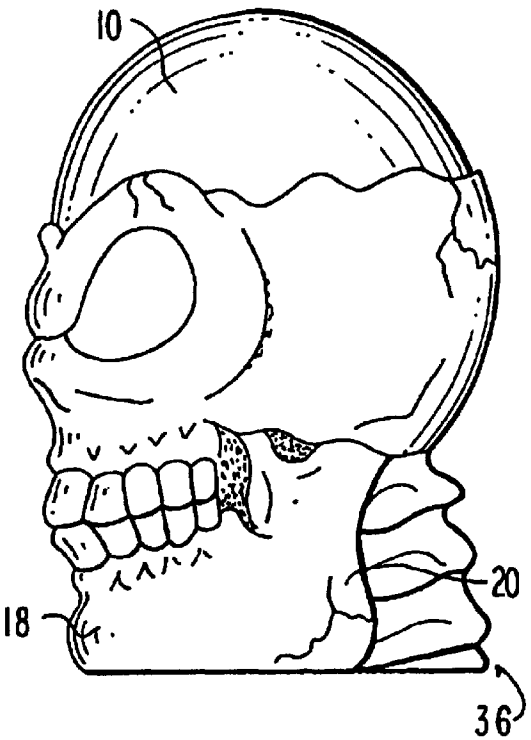
FIGS. 11, 12 and 13 are left, front and right side views of a fourth embodiment.
Figure 12:
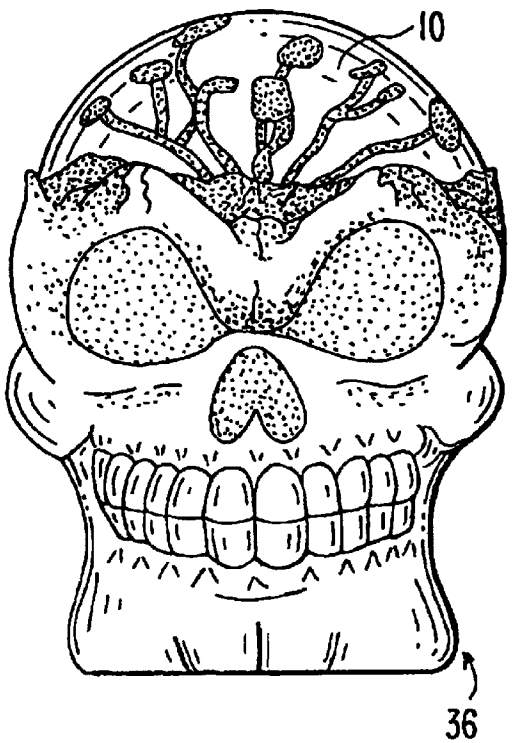
Figure 11:
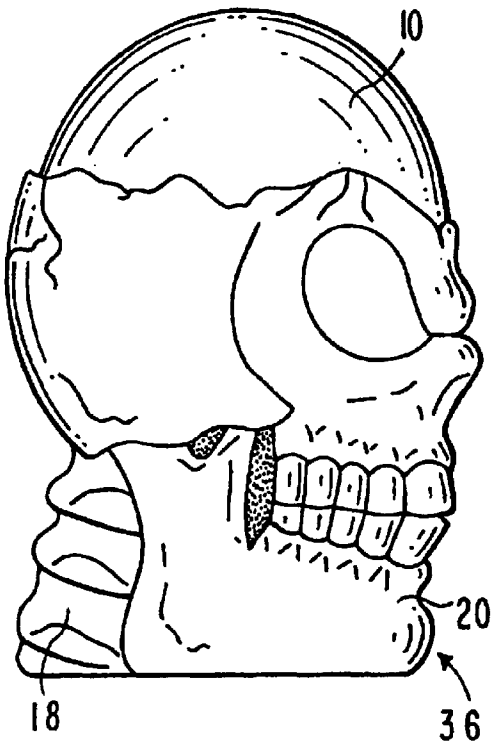

FIGS. 2–4 show an embodiment of a mad scientist 30. FIGS. 5–7 show an embodiment of an alien 32. FIGS. 8–10 show an embodiment of a monster 34. FIGS. 11–13 show an embodiment of a skull 36. Each embodiment have certain characteristics in common, besides conveying the appearance of an imaginary being that looks freakish or a mutation of the human head. In all cases, a majority of the lower hemisphere of the bulb is covered by the decorative configuration of a face and a lower back of a head and at most only a minority of the upper hemisphere is covered by the decorative configuration. Further, the face has at least one facial feature, i.e., one eye or a pair of eyes, a nose, one ear or a pair of ears and a mouth. Any of these facial features may be open or made of a material that is either transparent or translucent to allow illumination from the bulb to shine through. The rest of the decorative configuration is made from either an opaque material, a translucent material or, if made of a transparent material, the transparent material is preferably Pantone coated or otherwise colored with an opaque or translucent color coating. The front views illustrate the effect of the plasma discharge as viewed through the bulb 10, which is transparent. The underside of each embodiment, although not shown, is plain and unornamented.

The spherical bulb 10 is supported securely within the decorative configuration 16. For instance, the support may be the inner surface of the decorative configuration 16 that is shaped to have a complementary concave cup shape sized to accommodate the lower hemisphere 14. The bulb 10 may be supported on a base or stand with the lower portion of the decorative configuration 16 covering sides of the base or stand, i.e., to provide the appearance of a neck (see FIG. 1). The base or stand may resemble that shown in dashed lines in U.S. Pat. No. D441,882 S. A suitable base or stand is furnished together with a spherical plasma bulb 10 that is manufactured by Xiang Feng Enterprise Co. Ltd. of Shanghai, China, Model XF-168.

Figure 14:
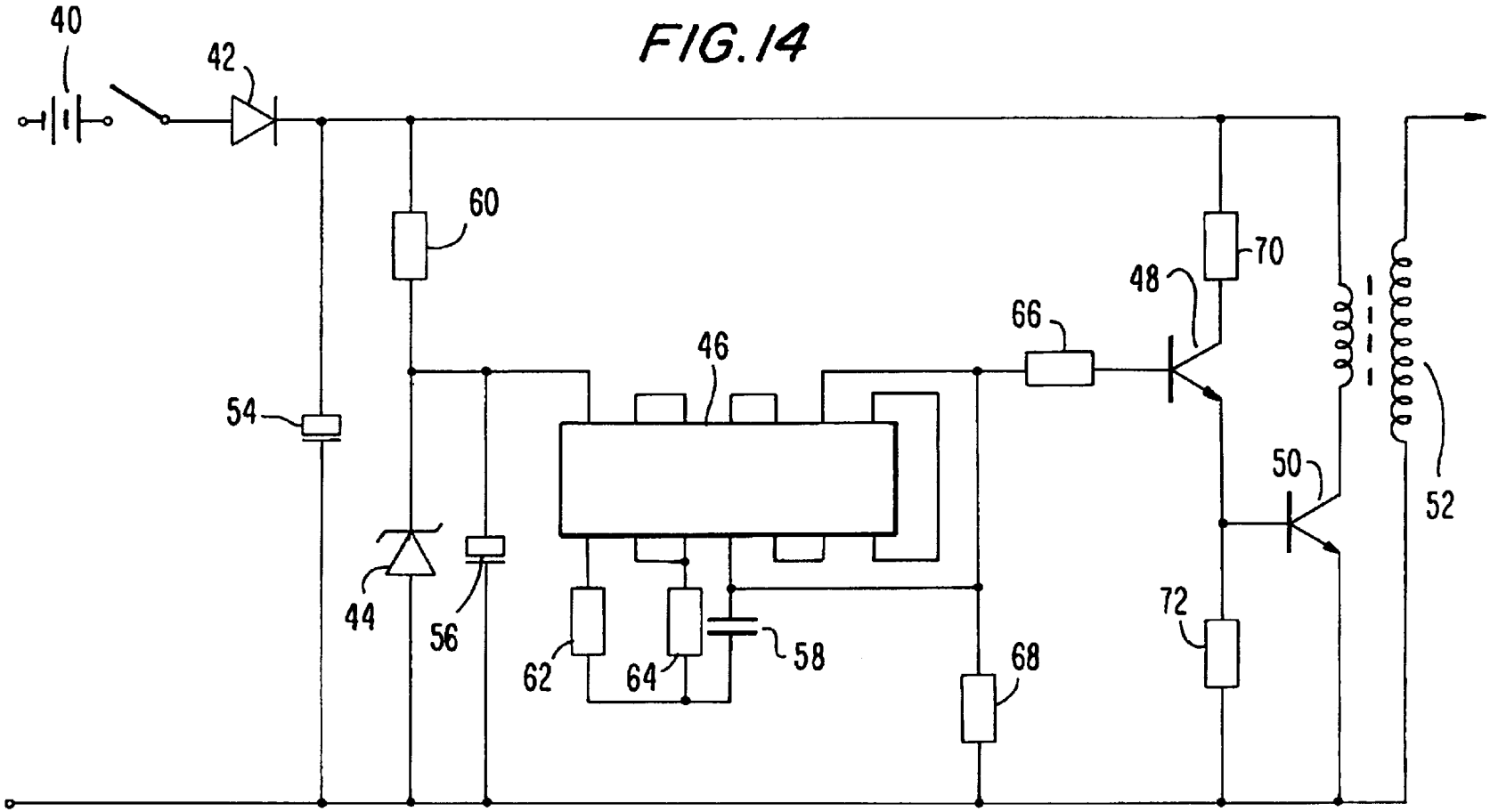
FIG. 14 is an electrical diagram of circuitry of the plasma lamp.

FIG. 14 shows an electrical diagram of the operative components 22 of FIG. 1 as plasma bulb control circuitry as manufactured by Xiang Feng Enterprise Co. Ltd. of Shanghai, China, Model XF-168. The diagram shows a battery 40, a diode 42, a regulated power supply 44, an integrated circuit 46, diodes 48, 50, a transformer 52, electrolytic cells 54, 56, electric capacitor 58, resistors 60, 62, 64, 66, 68, 70 and 72.

Uses for the present invention include decorative, nite light, Halloween party lamps, entertainment.

While the foregoing description and drawings represent the preferred embodiments of the present invention, it will be understood that various changes and modifications may be made without departing from the spirit and scope of the present invention.

What is claimed is:

1. A plasma lamp head, comprising a plasma lamp bulb that has a spherical shape and contains a plasma forming substance, operative components arranged to activate the plasma forming substance to excitation so as to provide illumination in response to delivery of activation energy; and a configuration that defines a cavity, the plasma lamp bulb being arranged to protrude out of the cavity, the configuration being contoured into a shape that has an appearance of a head with at least one facial feature selected from a group consisting of an eye, a pair of eyes, an ear, a pair of ears, a nose and a mouth, the plasma lamp bulb having a lower hemisphere and an upper hemisphere; the configuration covering at least a majority of the lower hemisphere and at most a minority of the upper hemisphere.

2. A plasma lamp head as in claim 1, wherein the upper hemisphere together with the configuration convey an appearance of an imaginary being, the imaginary being selected from a group consisting of a mad scientist, a freak, a mutant, a monster, an alien and a skull.

3. A plasma lamp head, comprising a plasma lamp bulb that has a spherical shape and contains a plasma forming substance, operative components arranged to activate the plasma forming substance to excitation so as to provide illumination in response to delivery of activation energy; and a configuration that defines a cavity, the plasma lamp bulb being arranged to protrude out of the cavity, the configuration being contoured into a shape that has an appearance of a head with at least one facial feature selected from a group consisting of an eye, a pair of eyes, an ear, a pair of ears, a nose and a mouth, the configuration being made of a material that is selected from a group consisting of opaque materials, translucent materials opaque covered transparent materials and translucent covered transparent materials.

4. A plasma lamp head, comprising a plasma lamp bulb that has a spherical shape and contains a plasma forming substance, operative components arranged to activate the plasma forming substance to excitation so as to provide illumination in response o delivery of activation energy; and a configuration that defines a cavity, the plasma lamp bulb being arranged to protrude out of the cavity, the configuration being contoured into a shape that has an appearance of a head with at least one facial feature selected from a group consisting of an eye, a pair of eyes, an ear, a pair of ears, a nose and a mouth, the at least one facial feature having an opening that enables the illumination from the bulb to shine through.

5. A plasma lamp head, comprising a plasma lamp bulb that has a spherical shape and contains a plasma forming substance, operative components arranged to activate the plasma forming substance to excitation so as to provide illumination in response o delivery of activation energy; and a configuration that defines a cavity and an edge that terminates the configuration and bounds an opening to the cavity, the plasma lamp bulb having a portion that is within the cavity and having a remainder that protrudes out of the cavity by extending through the opening, the configuration being contoured into a shape that includes an appearance of at least one facial feature selected from a group consisting of an eye, a pair of eyes, an ear, a pair of ears, a nose and a mouth.

6. A plasma lamp head as in claim 5, wherein the at least one facial feature has a portion that is made of a material that is either transparent or translucent.

7. A plasma lamp head as in claim 5, wherein the plasma lamp bulb has a lower hemisphere and an upper hemisphere; the configuration covering at least a majority of the lower hemisphere and at most a minority of the upper hemisphere.

8. A plasma lamp head as in claim 5, wherein the configuration is made of a material that is selected from a group consisting of opaque materials, translucent materials opaque covered transparent materials and translucent covered transparent materials.

9. A plasma lamp head as in claim 5, wherein the configuration has an inner facing surface that has a curvature that complements that of the plasma lamp bulb to accommodate same.

10. A plasma lamp head as in claim 5, further comprising a base arranged to support the plasma lamp bulb, that base having sides covered by a portion of the configuration.

11. A plasma lamp head as in claim 5, wherein the spherical shape has a lower hemisphere and an upper hemisphere, the configuration being arranged to cover at least a majority of an exterior surface of the lower hemisphere.

12. A plasma lamp head, comprising a plasma lamp bulb that has a spherical shape and contains a plasma forming substance, operative components arranged to activate the plasma forming substance to excitation so as to provide illumination in response to delivery of activation energy; and a configuration that defines a cavity, the plasma lamp bulb being arranged to protrude out of the cavity, the configuration being contoured into a shape that has an appearance of a head with at least one facial feature selected from a group consisting of an eye, a pair of eyes, an ear, a pair of ears, a nose and a mouth, the configuration having an inner facing surface that has a curvature that complements that of the plasma lamp bulb to a accommodate same.

13. A plasma lamp head, comprising a plasma lame bulb that has a spherical shape and contains a plasma forming substance, operative components arranged to activate the plasma forming substance to excitation so as to provide illumination in response o delivery of activation energy; a configuration that defines a cavity, the plasma lamp bulb being arranged to protrude out of the cavity, the configuration being contoured in a shape that has an appearance of a head with at least one facial feature selected from a group consisting of an eye, a pair of eyes, an ear, a pair of ears, a nose and a mouth; and a base arranged to support the plasma lamp bulb, the base having sides covered by a portion of the configuration.

14. A plasma lamp head, comprising a plasma lamp bulb that has a spherical shape and contains a plasma forming substance, operative components arranged to activate the plasma forming substance to excitation so as to provide illumination in response to delivery of activation energy; and a configuration that defines a cavity, the plasma lamp bulb being arranged to protrude out of the cavity, the configuration being contoured into a shape that has an appearance of a head with at least one facial feature selected from a group consisting of an eye, a pair of eyes, an ear, a pair of ears, a nose and a mouth, the portion of the configuration being contoured to have a shape of a neck.

15. A plasma lamp head, comprising a plasma lamp bulb that has a spherical shape and contains a plasma forming substance, operative components arranged to activate the plasma forming substance to excitation so as to provide illumination in response o delivery of activation energy; and a configuration that defines a cavity, the plasma lamp bulb being arranged to protrude out of the cavity, the configuration being contoured into a shape that has an appearance of a head with at least one facial feature selected from a group consisting of an eye, a pair of eyes, an ear, a pair of ears, a nose and a mouth, the spherical shape having a lower hemisphere and an upper hemisphere, the configuration being arranged to cover at least a majority of an exterior surface of the lower hemisphere.

16. A plasma lamp head, comprising a plasma lamp bulb that has a spherical shape and contains a plasma forming substance, operative components arranged to activate the plasma forming substance to excitation so as to provide illumination in response to delivery of activation energy; and a configuration that defines a cavity and an edge that terminates the configuration and bounds an opening to the cavity, the plasma lamp bulb having a portion that is within the cavity and having a remainder that protrudes out of the cavity by extending through the opening.

17. A plasma lamp head as in claim 16, wherein the plasma lamp bulb has a lower hemisphere and an upper hemisphere; the configuration covering at least a majority of the lower hemisphere and at most a minority of the upper hemisphere.

18. A plasma lamp head as in claim 16, wherein the configuration is made of a material that is selected from a group consisting of opaque materials, translucent materials opaque covered transparent materials and translucent covered transparent materials.

19. A plasma lamp head as in claim 16, wherein the configuration has an inner facing surface that has a curvature that complements that of the plasma lamp bulb to accommodate same.

20. A plasma lamp head as in claim 16, further comprising a base arranged to support the plasma lamp bulb, that base having sides covered by a portion of the configuration.

21. A plasma lamp head as in claim 16, wherein the spherical shape has a lower hemisphere and an upper hemisphere, the configuration being arranged to cover at least a majority of an exterior surface of the lower hemisphere.

* * * * *